US005912939A

United States Patent [19]

Hirsch

[11] Patent Number: 5,912,939

[45] Date of Patent: Jun. 15, 1999

[54] SOFT X-RAY MICROFLUOROSCOPE

[76] Inventor: Gregory Hirsch, 365 Talbot Ave., Unit D8, Pacifica, Calif. 94044

[21] Appl. No.: 08/864,019

[22] Filed: May 27, 1997

Related U.S. Application Data

[63] Continuation-in-part of application No. 08/797,362, Feb. 7, 1997, abandoned.

[51] Int. Cl.[6] ..... G21K 7/00

[52] U.S. Cl. ..... 378/43; 378/190

[58] Field of Search ..... 378/43, 62, 190

[56] References Cited

U.S. PATENT DOCUMENTS

| | | | |
|---|---|---|---|
| 3,860,819 | 1/1975 | Rabodzei et al. | 378/43 |
| 4,379,348 | 4/1983 | Haas et al. | 378/190 X |
| 4,498,894 | 2/1985 | Heilweil | 252/8.5 M |
| 4,979,203 | 12/1990 | Suckewer et al. | 378/206 |
| 5,045,696 | 9/1991 | Hirose | 378/43 |
| 5,104,733 | 4/1992 | Kasakevich et al. | 428/332 |
| 5,262,480 | 11/1993 | Lee | 525/92 D |
| 5,304,599 | 4/1994 | Himes | 525/98 |
| 5,434,901 | 7/1995 | Nagai et al. | 378/43 |
| 5,450,463 | 9/1995 | Iketaki | 378/43 |
| 5,510,072 | 4/1996 | Rosenqvist et al. | 264/184 |
| 5,548,030 | 8/1996 | Hoxmeier | 525/314 |
| 5,559,165 | 9/1996 | Paul | 523/111 |
| 5,569,642 | 10/1996 | Lin | 507/103 |

OTHER PUBLICATIONS

RHEOX, Inc., "*Baraqel® 3000 Rheological Additive for Lubricating Grease Manufacture*", RHEOX, Inc., P.O. Box 700, Hightstown, NJ 08520, 1992.

Technical Bulletin Shell Chemical Company, SC:1102–89, "*Kraton® Thermoplastic Rubbers in Oil Gels*" pp. 3–11, Apr. 1989.

Kraton Thermoplastic Rubber, pp. 1–20, Shell Chemical Company, Houston, Texas (1993).

*Primary Examiner*—David P. Porta

*Attorney, Agent, or Firm*—Townsend and Townsend and Crew

[57] ABSTRACT

A plasma source of soft x-rays provides the illumination for a microfluoroscope. In general, an x-ray relay optic collects part of the diverging plasma radiation and redirects it to a distant plane. At that plane, the fine-grained or grainless fluorescent screen of a microfluoroscope is placed to receive the radiation. A specimen is placed in direct contact with the screen, or in very close proximity, so that its x-ray shadow is projected onto the screen. The screen is very thin and transparent to visible or ultraviolet light so that a high-numerical-aperture optical microscope objective can closely approach and view the screen from the opposite side. The optical microscope views the fluorescent light emitted by the screen, which corresponds to the x-ray absorption shadow of the specimen. In general, a very thin, x-ray transparent vacuum window is used to separate the specimen, fluorescent screen, and microscope from the vacuum of the plasma source. Thin-film filters and/or monochromator devices are used to limit the wavelengths of soft x-rays which reach the fluorescent screen to the desired energy range. The use of the apparatus and process occurs with either a separate instrument or as an add-on feature to a conventional optical microscope.

47 Claims, 4 Drawing Sheets

SOFT X-RAY MICROFLUOROSCOPE

This application is a continuation-in-part of Ser. No. 08/797,362, filed Feb. 7, 1997 now abandoned.

BACKGROUND OF THE INVENTION

The general subject matter of this invention, the microfluoroscope, is a device which dates to several publications in the 1940's and 1950's (Pattee, H. H., "The Microfluoroscope," *Science,* (1958) 128: 977–981). The microfluoroscope is essentially identical in principle to the common medical fluoroscope. In medical fluoroscopy, a patient is placed between a source of x-rays (an x-ray tube) and a fluorescent screen. The x-ray shadow of the patient's internal bones and organs are projected onto the fluorescent screen, converted to visible light, and viewed in real-time. Modern medical fluoroscopy has been improved over the years with the introduction of image intensifying devices which increase the visibility of the image, while lowering the x-ray dose to the patient.

A microfluoroscope is simply a fluoroscope in which the small fluorescent screen is viewed with an optical microscope, allowing the observation of object features too small to be seen with the naked eye. The microfluoroscope requires the use of extremely fine-grained or grainless fluorescent screens to prevent the image from being dominated by the structure of the phosphor itself. The phosphor layer is also preferably very thin, so that the light-emitting layer is completely within the depth of field of the optical microscope. The objects examined are generally thin specimens which are placed in direct contact, or very close proximity, to the phosphor layer. The phosphor is deposited onto a thin transparent substrate, which allows for the close approach of the high-aperture objective lens of an optical microscope from the opposite side of the substrate. Since very small objects are the subject matter of investigation with the microfluoroscope, extremely low energy (soft) x-rays are needed to achieve adequate contrast.

Microfluoroscopy is a type of contact x-ray microscopy, also known as microradiography. In standard contact microscopy, a sample is placed directly onto the surface of an x-ray sensitive recording medium. Originally, this medium was a fined grained silver halide photographic emulsion. After exposure, the medium is developed and the image examined using light microscopy. In certain cases, the silver grain structure of the developed emulsion can be prepared in a manner suitable for electron microscopy examination at higher resolution.

More recently, photographic emulsions have been replaced by x-ray sensitive photoresists which have a much smaller intrinsic structure (the polymer molecule size) than photographic emulsions. The exposure of the photoresist to x-rays causes radiation damage, which leads to variations in the solubility of the photoresist in a subsequent developer solution. Thus, the variable transmission of the x-rays through the specimen is translated into a relief image of the specimen on the photoresist surface. This image can be viewed at very high resolution using electron microscopy or atomic force microscopy. Specimen feature sizes near 100 Å have been observed with this technique.

It is important to realize that the resolution of any contact microscopy scheme is limited by Fresnel diffraction. This resolution is given by:

$$\delta \approx (\lambda d)^{1/2}$$

where $\lambda$ is the wavelength of the radiation and d is separation between the feature being imaged and the recording surface. Therefore, an extremely high resolution contact image is possible only for features very close to the recording surface. For example, with 25 Å radiation, features 1 micron from the photoresist surface will be recorded at a resolution of no better than 500 Å.

There is a third type of contact microscopy that, like microfluoroscopy, is capable of real-time imaging. This microscope uses the photoconversion-contact method (Huang, L. Y., *Z. Physik* (1957) 149:225). In this technique, the specimen is placed on a thin x-ray transparent membrane. A photoemissive layer is deposited on the other side of the membrane, and this surface is in a vacuum. Photoelectrons are emitted into the vacuum by the photoemissive layer in response to the x-ray contact image of the specimen. These photoelectrons are accelerated, magnified by standard electron optics, and imaged onto an electron area-detector. An alternate scheme uses a simple point-projection principle instead of conventional electron optics (G. Hirsch, *Point Projection Photoelectron Microscope with Hollow Needle,* U.S. Pat. No. 4,829,177 (1989)). The photoconversion-contact method requires more complex and expensive instrumentation than a microfluoroscope.

Statement of the Problem

In what follows, an analysis of this problem area is traced with considerable discussion, leading to the solution. In this discussion, the reader should understand that the prior art and known techniques referred to do not of necessity lead to the solution. This analysis or statement of the problem is believed by the inventor to be a matter of first impression. Accordingly, invention is claimed in defining the problem to be solved, as well as in the solutions that follow once the problem is defined.

Because a microfluoroscope converts a potentially high resolution x-ray contact image to visible light, it is reasonable to question why the technique is of much value, since the resolution will be limited to that of the light microscope used to view the screen. At first glance, it may appear that the same results could be obtained by simply using light microscopy and that one is defeating the whole purpose of using X-rays. Closer examination reveals that the use of x-rays in a microfluoroscope has two important advantages over light microscopy, even though the resolutions are comparable. The first issue is that there are different contrast mechanisms used by the two techniques. When using x-rays, it is possible to map the location and concentration of various elements in a specimen. This is accomplished by tuning the photon energy across the absorption edges of specific elements and recording two different images on either side of the absorption edge. The two images are then digitally subtracted, with the resulting difference corresponding to the element in question.

The second and probably most useful feature is the very large depth of field of the x-ray contact image. With high numerical-aperture optics, light microscopy has an extremely narrow depth of field (a few tenths of a micron). In a standard light microscope, this causes the out-of-focus features of the specimen to generate a very disturbing haze which can overwhelm the in-focus features. This problem has been solved with confocal microscopes, where only the in-focus plane is observed by the microscope. With a confocal microscope, three-dimensional information can be obtained by taking a series of "optical sections" and then using computer software to reconstruct the sample. However, this is a time consuming process which makes it difficult or impossible to observe rapidly changing objects such as living biological specimens. With the microfluoroscope, it is possible to observe the whole sample simultaneously due to the sharp projection of the three-dimensional object onto the two-dimensional phosphor surface. Three-dimensional information can be obtained by recording two images at slightly different angles of incidence to the x-rays, and thereby producing a stereo pair.

It is worth noting that the effective resolution obtained with complex objects using optical microscopy is seldom as good as the theoretical performance level for simple two-dimensional binary test objects. Since the microfluoroscope projects complex three-dimensional information onto a two-dimensional plane, it is easier for an optical microscope to perform at a resolution level approaching the theoretical limits.

In a standard microfluoroscope, the x-rays are generated by the usual method of bombarding a metal target with high-energy electrons. The prime difficulty of microfluoroscopy is achieving an adequate x-ray flux on the screen using these conventional electron impact sources. This is due to the extremely low efficiency for generating soft x-rays by electron impact. This problem has been partially addressed by using microfocus x-ray sources which are placed very close to the object and screen. The use of a microfocus source is preferable to a standard x-ray tube because it can generate the highest usable x-ray flux on the specimen. This can be understood from the following argument. First, the maximum power that an x-ray tube can dissipate is directly proportional to the size of the target focal spot. Secondly, the x-ray flux follows an inverse-square law. Finally, the closest approach of the target to the sample is determined by the penumbral blurring of the contact image due to the finite source size, and is therefore proportional to the spot size. Therefore, the flux on the fluorescent screen can be increased inversely proportional to the focal spot size on the x-ray source, assuming a constant penumbra size and maximum target loading.

It is not possible to operate microfocus tubes at voltages below roughly 5 kilovolts due to space charge problems and chromatic aberration. For imaging thin biological features, the desired x-ray photon energies are well below 5 keV. Therefore, it is necessary to use the low energy tail of the x-ray spectrum emitted by the source. In a microfluoroscope, this is to some extent possible by using a very thin phosphor layer. In this case, much of the harder radiation will pass through the specimen and phosphor unabsorbed, allowing most of the image contrast to be contributed by the easily absorbed soft x-rays. However, the efficiency of x-ray production for electron impact sources becomes progressively worse for softer radiation.

In previous publications on microfluoroscopy, the softest x-ray wavelengths used were generally around 10 Å. This was extended to near 20 Å in some cases, but with extremely low flux and therefore very long exposure times. In the case of very small biological samples, such as hydrated single cells, it is highly desirable to operate in an even softer wavelength range known as the "water window". This is the energy range lying between the K-edges of oxygen and carbon (23.4–43.8 Å). In this range, water is relatively transparent compared to the carbon-containing organic material. This permits the high-contrast imaging of unstained samples in water. It is possible to view completely unaltered, living samples in this energy range. Electron impact sources of radiation are completely inadequate for the production of significant x-ray power in the water window range. In the case of living specimens, the sample would move appreciably during the long exposures.

In recent years, high-intensity sources of soft x-rays have been developed. The highest average power levels are found in the intense synchrotron radiation which is emitted by relativistic electrons orbiting in high-energy storage rings. This radiation has the desirable qualities of very high intensity, excellent collimation, very stable output, and a continuous spectral distribution which can be tuned over very narrow bands with monochromators. While synchrotron radiation is an ideal source in the energy range of interest for soft x-ray imaging, it is not a suitable source for general use in small laboratories due to the massive size and cost of the sources.

Fortunately, other intense sources have been developed which are compact and relatively inexpensive. These sources use the x-ray emission from very hot plasmas. This emission is composed of both characteristic line spectra from the plasma ions, and continuum radiation. Several different methods for generating the plasmas have been developed. Much of the development has concentrated on plasmas created by illuminating a target with the very high-power density of a focused laser beam pulse. Plasma sources are superior to synchrotron radiation in one respect; they have a much higher peak power level. In some cases, this allows an image of a specimen to be recorded with only one shot of the source. Since the pulse duration is typically only a few nanoseconds, any motion of the sample due to specimen motility, Brownian motion, or radiation damage will be frozen.

It is possible to produce soft x-ray laser emission from a hot plasma. The peak power levels from these x-ray lasers are extremely high and have been used to record contact microscopy images and x-ray holograms. Unfortunately, like synchrotron radiation sources, they are very large and expensive instruments. X-ray lasers may become smaller and less expensive in the future with improved technology.

The microfluoroscope was developed before the advent of high resolution x-ray microscopy techniques. At that time, the resolution of x-ray microscopy was generally no better than light microscopy. Therefore, the resolution limit of the microfluoroscope, which is determined by the numerical aperture of the optical microscope, was not considered to be a serious disadvantage. The ability to observe a specimen in real-time, on the other hand, is quite advantageous. This situation changed after the introduction of high resolution soft x-ray microscopy techniques.

One of these techniques is the previously mentioned contact microscopy using high resolution photoresists. In addition to contact microscopy, several other types of high resolution soft x-ray microscopes having real-time imaging capability have been developed which use advanced x-ray optics. These optics include grazing incidence, normal incidence/multilayer, and Fresnel zone-plate optics. The best of these x-ray optics-based microscopes now allow samples to be viewed with soft x-rays at a resolution of ≈300 Å. However, this performance level can be achieved only with microscopes using expensive state-of-the-art optics and advanced synchrotron radiation sources.

It is important to note that the required radiation dose to a specimen, assuming a constant signal-to-noise ratio and detection efficiency, scales as the inverse-cube of the smallest resolvable features. This is due to photon-counting statistical noise. Therefore, as the minimum resolvable feature size decreases, it becomes progressively more difficult to view changing biological processes in a single specimen due to severe radiation damage to the specimen. The maximum dose threshold before cellular death is specimen dependent, but is near the resolution limits of the microfluoroscope. This means that even if the microfluoroscope had a better resolution, it would not be particularly useful for producing a series of sequential images of biological processes at high resolution.

Due to the strong current emphasis on very high resolution x-ray microscopy, which cannot be achieved with microfluoroscopy, the microfluoroscope has become rather obscure. It is likely that most workers in the field of microscopy are not even aware of the method. A good indication of the scant level of current interest in microfluoroscopy is the complete lack of mention of the technique in modern review articles on soft x-ray microscopy. However, a compact microfluoroscope using a modern plasma source of soft x-rays would have several very attractive features to recommend it. Such an instrument would allow the dynamic imaging of samples at the resolution limits of optical microscopy, but without the severe limitation of optical microscopy's extremely narrow depth of focus with high-numerical-aperture optics. The resolution performance could reach ≈2000 Å with visible emitting fluorescent screens, and ≈1000 Å with ultraviolet emitting screens. This would be accomplished with a much lower cost and a simpler instrument than existing high resolution soft x-ray microscopes.

This instrument could also be an add-on option for a standard optical microscopy system. A plasma-source-based microfluoroscope would allow soft x-ray microscopy to become a routine technique for workers in many fields. In addition, conventional contact microscopy could be performed using the same source when it was necessary to record very high resolution images. It would be possible to view a single specimen using light microscopy, microfluoroscopy, and contact microscopy to take advantage of the respective advantages of each technique. The instrument would be especially useful for biological and medical studies. It would appear that the use of modern sources that could revive interest in the microfluoroscope has been overlooked.

SUMMARY OF THE INVENTION

A plasma source of soft x-rays provides the illumination for a microfluoroscope. In the first embodiment, an x-ray relay optic collects part of the diverging plasma radiation and redirects it to a distant plane. At that plane, the fine-grained or grainless fluorescent screen of a microfluoroscope is placed to receive the radiation. A specimen is placed in direct contact with the screen, or in very close proximity, so that its x-ray shadow is projected onto the screen. The screen is very thin and transparent to visible or ultraviolet light so that a high-numerical-aperture optical microscope objective can closely approach and view the screen from the opposite side. The optical microscope views the fluorescent light emitted by the screen, which corresponds to the x-ray absorption shadow of the specimen. In general, a very thin, x-ray-transparent vacuum window is used to separate the specimen, fluorescent screen, and microscope from the vacuum of the plasma source. Thin-film filters and/or monochromator devices are used to limit the wavelengths of soft x-rays which reach the fluorescent screen to the desired energy range. The use of the apparatus and process occurs with either a separate instrument or as an add-on feature to a conventional optical microscope.

In a second embodiment, a miniaturized plasma source is used which does not require relay optics for redirecting the divergent plasma produced x-rays to a distant plane. Instead, the miniature source is used as a close proximity point-source of radiation. This source can be used with a conventional optical microscope by placing it between the microscope condenser optics and the objective lens.

DESCRIPTION OF THE PREFERRED EMBODIMENT

Figure 1:
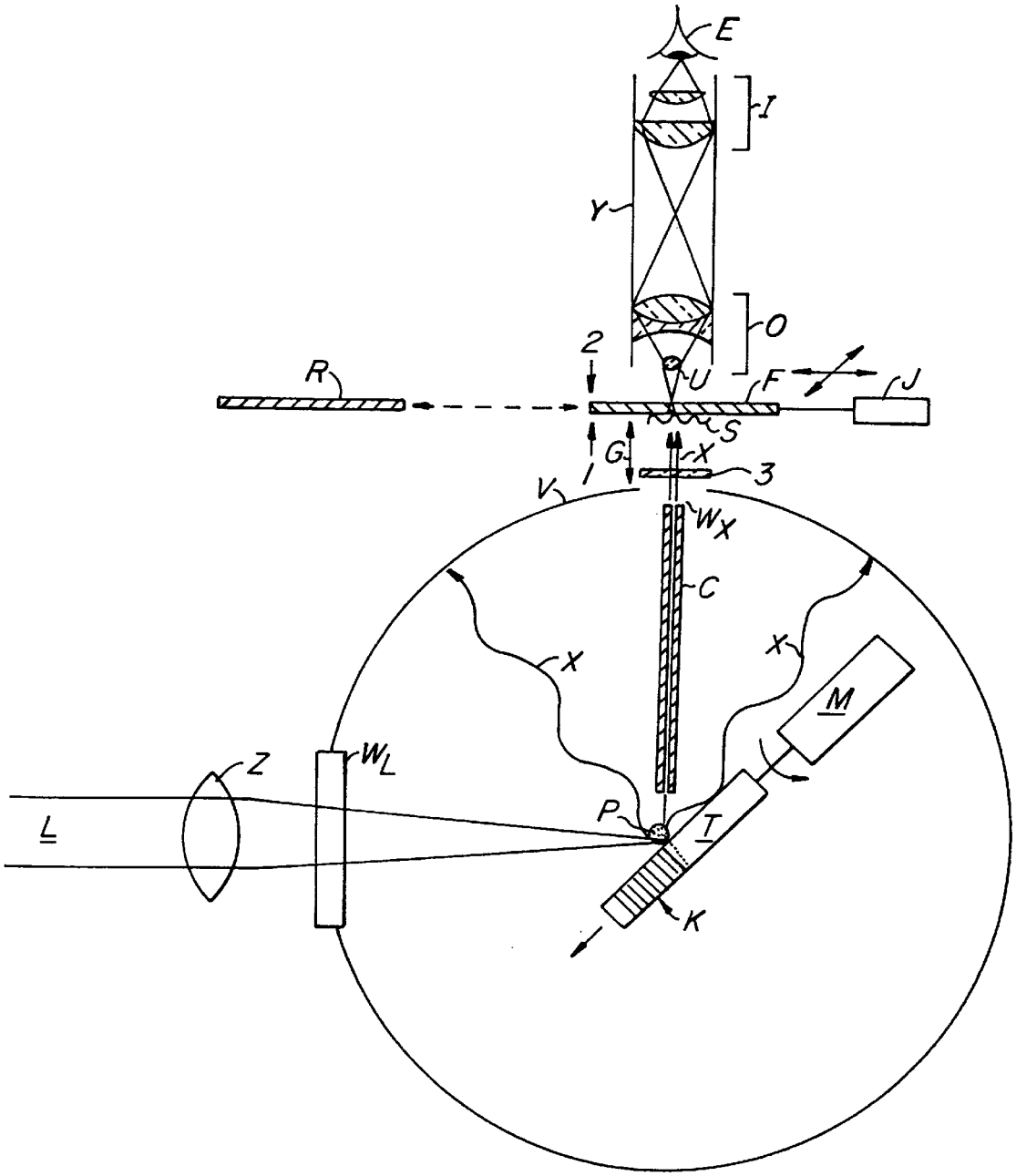
FIG. 1 illustrates a microfluoroscope using a laser-plasma x-ray source for illumination.

Referring to FIG. 1, the preferred embodiment of this microfluoroscope uses a laser-produced plasma as the source of soft x-rays. This type of source is preferred to other types of plasma sources due to its simplicity, reliability, high repetition rate, consistent location of the plasma from shot-to-shot, and small source size. For generating soft x-rays, a spot on the target T in a vacuum chamber V is illuminated by a high-power pulsed laser beam L. The laser itself and the vacuum pump for evacuating the chamber are not shown. The laser beam is focused onto the target surface by a lens Z which illuminates the target through vacuum window $W_L$. Of course, the focusing lens could be situated inside the vacuum chamber. The vacuum environment is necessary to prevent electrical breakdown of the air by the focused laser beam, as well as to prevent absorption of soft x-rays by gas. It is possible to operate a laser-plasma source in a partial vacuum, especially with helium as the gas. The high power density of the beam on the target creates an expanding plasma P which emits radiation X, which includes soft x-rays. One of the convenient features of laser-plasma sources is that the laser optical path stays clean, even though plasma debris lands on the optic surfaces exposed to the plasma. The clean optical path is due to the continuous ablation of condensed debris material on the optical surfaces under the high laser power. For producing x-rays in the water window range, a target irradiance of $10^{12}$–$10^{13}$ Watts/cm$^2$ is optimal. Following previous designs, the target is preferably a rotating cylinder mounted on a motor M. The motor drives the target cylinder on a helical thread so that a fresh surface is exposed for each shot, or for a fixed number of shots. Therefore, a helical pattern of small craters K is created on the target surface. This allows the target to last for a large number of shots before it has to be replaced. Other target geometries such as wires or tapes have been used advantageously. There has been some investigation of using gas targets which have the advantage of not producing a shower of condensable plasma debris. There are other types of plasma sources that include: gas-puff z-pinches, electron beam/plasma interaction sources, and dense plasma focus devices, which can also be used by this technique. While all of these sources produce copious amounts of soft x-rays, they have features which make them generally not as attractive as the laser-produced plasma source.

Regarding the required laser, it is instructive to consider what power level is required to achieve the desired target irradiance of $10^{12}$–$10^{13}$ Watts/cm$^2$. A common choice for the laser type is a Q-switched Nd:YAG laser. With a typical mid-size laser having a pulse length of 5 nsec and pulse energy of 0.5 Joules, the peak power is $10^8$ Watts. To achieve $10^{12}$ W/cm$^2$, a focal spot size of ≈110 microns is required. This is easily achieved with a single-mode laser and a low-cost focusing lens. It is desirable to use the lowest power, and therefore the least expensive laser possible. The output of the laser can be reduced from the above parameters by achieving a smaller focal spot. Other common lasers used for generating x-ray emitting plasmas are Nd:glass, and excimer lasers.

Due to the plasma debris and vacuum environment of the source, it is not necessarily desirable to have the microfluoroscope screen F positioned in close proximity to the plasma. If the source is placed some distance away, the radiation flux will decrease by the inverse-square law if no optics are used to redirect the diverging radiation. Therefore, a relay optic of some sort is desirable to focus the source on the fluorescent screen to maintain a reasonable radiation flux. In this embodiment, a glass capillary tube C is used to transmit x-rays from the plasma to the fluorescent screen. Because x-rays have an index of refraction slightly less than unity in all materials, they will be reflected by total external reflection at grazing incidence angles. Therefore, a hollow glass capillary tube functions as an x-ray guide, similar to a solid fiber optic with visible light. A typical capillary inside-diameter range is 100–500 microns. The distance of the capillary entrance from the plasma is typically a few centimeters. There are other types of relay-optics which can be used with this invention which use grazing incidence optics such as toroidal mirrors, or normal-incidence multilayer mirrors. The glass capillary optic has the advantage that it can be replaced very inexpensively after it becomes coated with too much plasma debris material.

The extremely hot plasma of the source emits a wide spectrum of radiation which ranges from the infrared to the soft x-ray range. It is necessary to remove all of the photons which are not in the energy range desired for the optimal imaging of the specimen. This is to prevent poor contrast, large diffraction blurring, unnecessary radiation exposure, and heating of the specimen. This can be accomplished by placing a thin-film filter 3 in the optical path between the plasma and the fluorescent screen. Although it is shown in the air gap G, the filter could be placed in other locations. It should be understood that more sophisticated optics which utilize x-ray monochromators for achieving tunable and narrow-band radiation could be used instead of simple filter elements. These optics would be much more complicated and costly than simple thin-film filters.

It is very desirable to have the fluorescent screen F outside of the vacuum environment of the target chamber. To achieve this, a thin window $W_x$ which supports 1 atmosphere pressure and is reasonably transparent to the soft x-rays is used to seal the target chamber. A good choice for this window is silicon nitride ($Si_3N_4$). This material can support an atmospheric pressure differential on a window several tenths of a millimeter across, when only 1000 Å thick. A window of this thickness will transmit well in most of the water window range. The gap G between the thin window and the fluorescent screen should be small due to the high absorption of soft x-rays by air. In some parts of the water window, the 1/e attenuation length is below 1 mm. This gap can be lengthened appreciably by replacing the air with a helium atmosphere.

Due to the limited resolution of microfluoroscopy, it is sometimes desirable to use conventional x-ray contact microscopy for higher resolution imaging. A photoresist-coated substrate R is shown which can replace the fluorescent screen. If the specimen S is placed directly on the fluorescent screen, it will be difficult to move it onto a photoresist for subsequent imaging without damaging it. However, it is possible to have the specimen supported on a very thin film (not shown) which would allow the specimen to be lifted from the fluorescent screen, moved onto the photoresist surface, and exposed with the plasma soft x-rays X.

The fluorescent screen F, or the optional photoresist R, is mounted on a scanner J for aligning a feature of interest to the x-ray beam and objective lens O. The objective lens is part of an optical microscope Y, which includes an eyepiece I for direct viewing of the fluorescent screen's output light U with the observers eye E. The microscope is focused on the front surface of the fluorescent screen 1 by viewing it through the back surface 2. It will be understood that the eyepiece and direct viewing could be replaced with several options (not shown) such as a television camera, an image intensifier tube, an ultraviolet image converter tube, an ultraviolet-to-visible-phosphor screen, a photographic camera, or some other sort of image recording device. Electronic recording devices could be interfaced with a computer for image processing.

Figure 2:
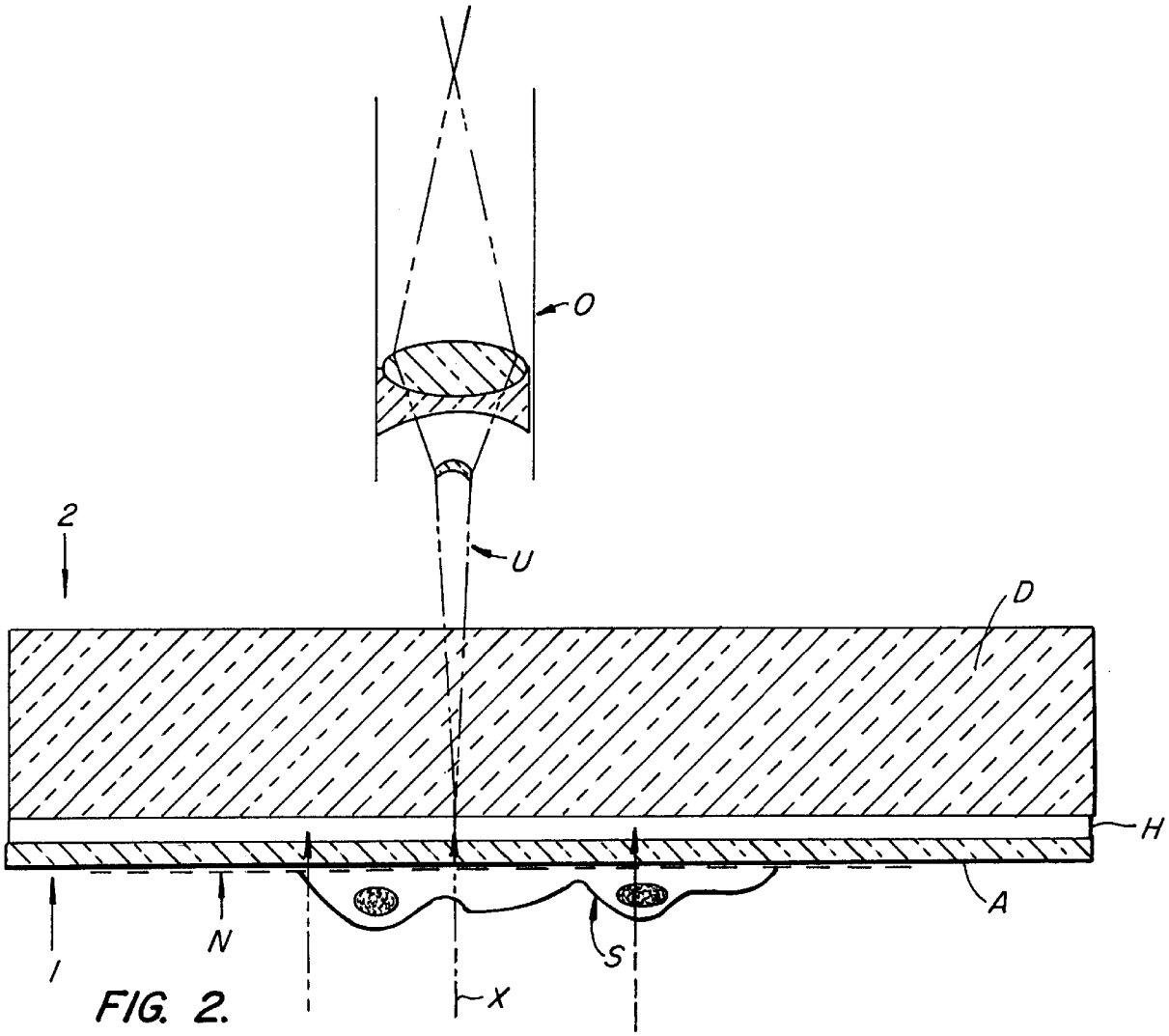
FIG. 2 illustrates a close-up view of the fluorescent screen region of FIG. 1.

Referring to FIG. 2, a close up view of the fluorescent screen region of the instrument is shown. There are several choices for the fluorescent screen. Shown in the figure is a standard phosphor screen, which is composed of a phosphor powder layer H deposited onto a thin transparent substrate D. An optional thin metal coating A, such as several hundred Angstroms of aluminum, is shown over the phosphor layer. A specimen S is placed directly on the metal film or is positioned in close proximity. The metal coating is used to block any stray light from direct fluorescence of the specimen. The metal layer will also reflect the phosphor's fluorescent light U traveling away from the objective lens O back toward it to increase the signal. Standard phosphor powder fluorescent screens can be used with this technique, but the grain size must be extremely small. Transparent, vapor-deposited phosphor materials are a better choice for the phosphor layer since they form grainless films, although their efficiency is not as good as the standard powder screens. Another choice for the phosphor layer is an organic scintillator layer which can be spin-coated onto substrates. These organic compounds are more susceptible to radiation damage degradation, but this is not an important issue for this application, since the screens can be frequently replaced. Another possibility is a single-crystal scintillator screen, such as cerium doped YAG or YAP (not shown). In the case of single-crystal scintillators, there is not a separate substrate, rather the whole crystal is fluorescent. Fortunately, the soft x-rays are attenuated extremely rapidly in the crystal, so that all the fluorescence is generated in a very thin surface layer, and there is not a great deal of out-of-focus fluorescent light. The thickness of the fluorescent screen should be very thin to allow the close approach of the objective lens O of an optical microscope to the front surface of the phosphor screen 1 from the back surface 2 The objective lens must be corrected for any spherical aberration caused by the thickness of the screen. This is easily provided if the screen has the same optical thickness as a microscope cover glass, and a standard cover-glass-corrected objective is used. In the standard operation of the microscope, a specimen S is placed directly onto the front surface 1 of the screen F. An alternate specimen mounting arrangement is to have the specimen S supported on a very thin film N, such as carbon, which allows the specimen to be removed from the fluorescent screen.

It is desirable to achieve the highest resolution possible with the optical microscope used to view the screen. The resolution of an optical microscope is given by:

$$\delta \approx \lambda / 2\ NA$$

where $\lambda$ is the wavelength of the light, and NA is the numerical aperture of the objective lens. The NA of a lens is given by:

$$n \sin \phi$$

where n is the index of refraction of the medium between the objective and the object, and $\phi$ is the half angle of the light cone collected by the objective lens. Therefore, it is desirable to use the highest NA objective possible, and to use a fluorescent screen with the shortest possible emission wavelength. For direct viewing of the screen by eye, it is obviously necessary to use visible light. If the objective is coupled to an ultraviolet sensitive device—such as a television camera, image intensifier, or image converter tube—then the short wavelength limit will be determined by the transmission of the optics or the response of the imaging device. If easily visible 5000 Å blue-green fluorescent light is used with a 1.4 NA oil-immersion objective, the resolution limit will be approximately 1800 Å. By using ultraviolet emitting fluorescent screens and high-quality ultraviolet optics, it should be possible to increase the resolution to 1000 Å or better. The shortest usable wavelength would be achieved by using an objective lens with all reflective optics which can operate well into the vacuum ultraviolet region. The limitation would then be the availability of short wavelength emitting phosphor materials, and the absorption of the ultraviolet fluorescence by the phosphor substrate.

Figure 3:
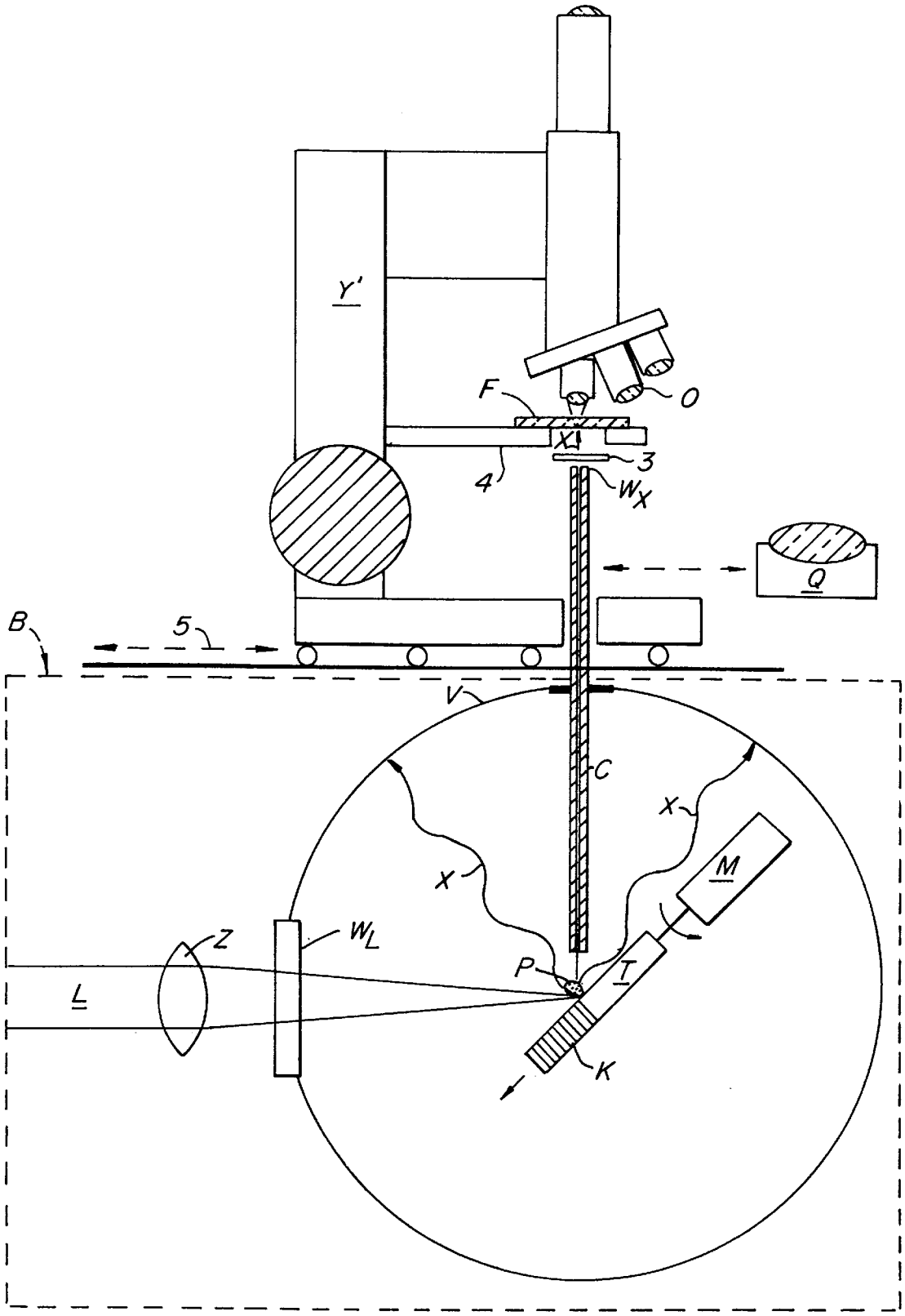
FIG. 3 shows a conventional optical microscope which incorporates a laser-plasma source for performing optical microscopy, as well as microfluoroscopy as an alternative mode of operation.

Referring to FIG. 3, an arrangement for performing both microfluoroscopy and standard light microscopy with the same relatively standard optical microscope is shown. When performing microfluoroscopy imaging in this embodiment, the optical microscope Y' has a movable light condenser-optic Q which is removed from its normal place below the microscope sample stage 4. The microscope is mounted above a laser-plasma x-ray source B, similar in construction to that shown in FIG. 1. One difference in the x-ray source shown here from FIG. 1 is a lengthened x-ray guide tube C with attached thin window $W_x$, which is extended upwards to closely approach the fluorescent screen F mounted on the microscope sample stage. The optical microscope is mounted on a linear slide bearing 5, so that it can be slid into place over the x-ray guide tube when the condenser optics are removed. Microfluoroscopy is performed when the system is in this configuration. For normal light microscopy operations (often on the same specimen), the microscope is slid away from the guide tube, and the condenser Q is replaced into its normal position below the microscope stage. Although shown with the x-ray source positioned below the microscope, an inverted microscope—which is often advantageous for biological applications—could be constructed. In this case, the plasma source and condenser optics would be positioned above the sample stage and objective lenses. Another possible configuration which would not require a removable condenser would be to have the x-ray source mounted to the side of the microscope and have the x-rays traveling horizontally. A multilayer mirror (not shown) mounted above the condenser would then be used to reflect the x-rays 90° and upward to the fluorescent screen. The multilayer mirror would also act as a monochromator. A microfluoroscope/optical microscope combination instrument as described here could use more sophisticated light optics for performing confocal, phase contrast, fluorescence, interference, or other advanced light microscopy techniques.

Figure 4:
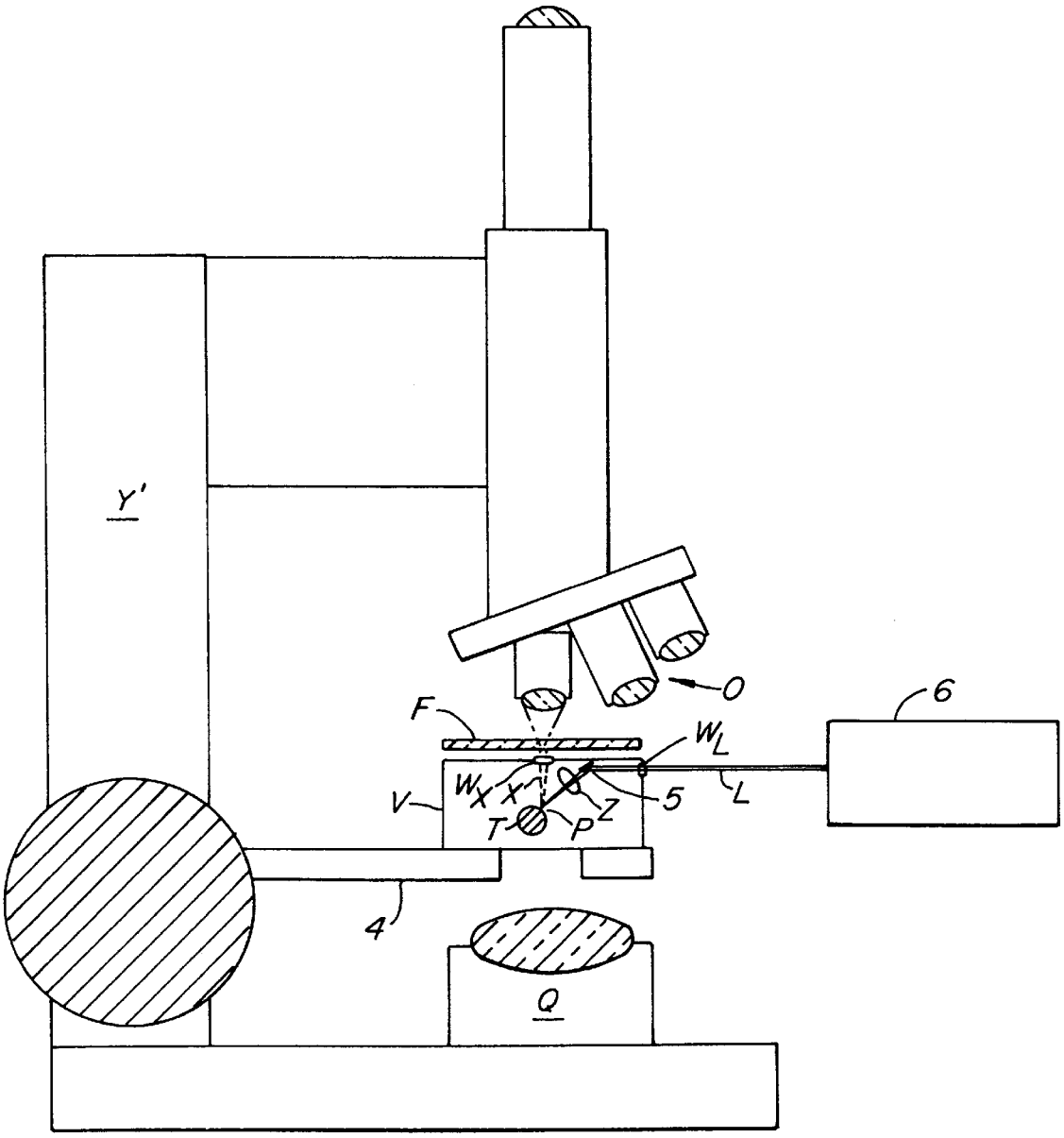
FIG. 4 shows a conventional optical microscope which incorporates a miniaturized laser-plasma source for performing microfluoroscopy.

Referring to FIG. 4, a miniaturized laser plasma source is placed directly onto the specimen stage 4 of a conventional optical microscope Y which has objective lenses O for viewing the fluorescent screen F. In this embodiment, the vacuum chamber V is reduced in height to fit between the microscope's condenser optics and the fluorescent screen. Often the plasma source is placed directly on the microscope sample stage. A small diameter cylindrical target T is positioned in the small vacuum chamber. Of course, as in the previous embodiments, other target geometries are possible. The distance between the laser-produced plasma P, and the x-ray transmissive window $W_X$ is typically less than 2 cm. The laser beam L enters the vacuum chamber through a window $W_L$ and is typically deflected downward by a mirror or prism 5. The beam is focused onto the target by a lens Z. Unlike the previous microfluoroscope embodiments, there are no relay optics to collect the diverging x-rays X. Instead, the plasma acts as a point source, and the close proximity of the source to the screen assures an adequate flux. By using a small target-to-fluorescent-screen distance, a lower energy laser 5 can be used if the focal spot is made small enough. For example, a target irradiance of $\mathbf{10}^{12}$ W/cm$^2$ can be achieved with a 5 nsec laser pulse of 20 mJ if the focal spot is reduced to 23 microns. Such lasers are very compact and relatively inexpensive. Due to the smaller energy of laser pulse (and plasma), the thin window $W_X$ can survive the close proximity of the plasma, although it will need periodic replacement as it gets coated with plasma debris. Although the laser-produced plasma is the preferred embodiment for the radiation source, it is possible to envision other miniaturized plasma sources such as hot electrical sparks. With proper design, it is possible to have visible light from condenser optics Q pass through the vacuum chamber to allow the almost simultaneous viewing of the specimen by light microscopy. As in the previous embodiment of FIG. 3, other specialized types of optical microscopes can be used such as confocal, phase contrast, fluorescence, interference, or other. The use of an inverted microscope geometry is also quite feasible, and would reduce some of the size constraints of the vacuum chamber. The reader will understand that the specimen is located as before; between the x-ray source and the screen. It is not shown in FIG. 4.

What is claimed is:

1. A microfluoroscope comprising:

a plasma source of soft x-rays for producing diverging plasma radiation;

a fluorescent screen placed at a distant plane to receive diverging plasma radiation;

means for placing a specimen in close proximity to the distant plane so that an x-ray absorption shadow of the specimen is projected onto the fluorescent screen; and an optical microscope for viewing fluorescent light emitted by the fluorescent screen corresponding to the x-ray absorption shadow of-the specimen.

2. A microfluoroscope according to claim 1 and herein:

the fluorescent screen is fine grained.

3. A microfluoroscope according to claim 1 and wherein:

the fluorescent screen is grainless.

4. A microfluoroscope according to claim 1 and wherein:

the fluorescent screen is a single-crystal scintillator.

5. A microfluoroscope according to claim 1 and wherein:

the means for placing a specimen in close proximity to the distant plane places the specimen in contact with the fluorescent screen.

6. A microfluoroscope according to claim 1 and wherein:

the fluorescent screen is very thin and transparent to visible or ultraviolet light so that a high-numerical-aperture optical microscope objective can closely approach and view the fluorescent screen.

7. A microfluoroscope according to claim 1 and wherein:

the plasma source is in a vacuum; and an x-ray transparent vacuum window is used to separate the specimen, fluorescent screen, and microscope from the vacuum of the plasma source.

8. A microfluoroscope according to claim 1 and wherein:

filters are used to limit the wavelengths of soft x-rays which reach the fluorescent screen to the desired energy range.

9. A microfluoroscope according to claim 8 and wherein:

the filters are monochromator devices.

10. A microfluoroscope according to claim 1 and wherein:

the plasma source for producing diverging plasma radiation includes a laser-produced plasma.

11. A microfluoroscope according to claim 1 and wherein:

the plasma source of soft x-rays is an x-ray laser.

12. A microfluoroscope according to claim 1 and wherein:

the soft x-rays are in the water window wavelength range.

13. A microfluoroscope according to claim 1 and wherein:

the specimen is living.

14. A microfluoroscope according to claim 1 and wherein:

the fluorescent screen emits ultraviolet fluorescence and the microscope has an objective lens which is compatible with UV light.

15. The combination with a conventional optical microscope for examining a specimen at a plane by microfluoroscopy comprising:

a plasma source of soft x-rays for producing diverging plasma radiation;

an x-ray relay optic aligned to collect at least part of the diverging plasma radiation and redirect part of the diverging plasma radiation to the focal plane of the conventional microscope;

a fluorescent screen placed at the focal plane of the conventional microscope to receive the redirected part of the diverging plasma radiation;

means for placing a specimen in close proximity to the focal plane of the conventional microscope so that an x-ray absorption shadow of the specimen is projected onto the fluorescent screen for examination by the conventional optical microscope.

16. The combination according to claim 15 and wherein:

the optical microscope has visible light condenser optics for performing standard light microscopy.

17. A combination according to claim 15 and wherein:

the plasma radiation is unobstructed by utilizing removable light condenser optics.

18. The combination according to claim 15 and wherein:

multilayer mirrors are used in conjunction with the x-ray relay optic for redirecting the plasma radiation.

19. The combination according to claim 15 and wherein:

the optical microscope has confocal optics.

20. The combination according to claim 15 and wherein:

the optical microscope has fluorescence contrast capabilities.

21. The combination according to claim 15 and wherein:

the optical microscope has phase contrast capabilities.

22. The combination according to claim 15 and wherein:

the optical microscope has interference contrast capabilities.

23. The combination with a conventional light microscope for examining a specimen by microfluoroscopy at a plane comprising;

a miniaturized plasma source of soft x-rays placed between the microscope condenser optics and the microscope objective-lens;

a fluorescent screen placed at the focal plane of the conventional microscope to receive diverging plasma radiation;

means for placing a specimen in close proximity to the focal plane of the conventional microscope so that an x-ray absorption shadow of the specimen is projected onto the fluorescent screen.

24. The invention according to claim 23 and wherein:

the miniaturized plasma source uses a laser-produced plasma.

25. A microflouroscope comprising:

a plasma source of soft x-rays for producing diverging plasma radiation;

an x-ray relay optic aligned to collect at least part of the diverging plasma radiation and redirect part of the diverging plasma radiation to a distant plane;

a fluorescent screen placed at the distant plane to receive the redirected part of the diverging plasma radiation;

means for placing a specimen in close proximity to the distant plane so that an x-ray absorption shadow of the specimen is projected onto the fluorescent screen; and an optical microscope for viewing fluorescent light emitted by the fluorescent screen corresponding to the x-ray absorption shadow of the specimen.

26. A microflouroscope according to claim 25 and wherein:

the fluorescent screen is fine grained.

27. A microflouroscope according to claim 25 and wherein:

the fluorescent screen is grainless.

28. A microflouroscope according to claim 25 and wherein:

the flourescent screen is a single crystal scintillator.

29. A microflouroscope according to claim 25 and wherein:

the means for placing a specimen in close proximity to the distant plane places the specimen in contact with the fluorescent screen.

30. A microflouroscope according to claim 25 and wherein:

the fluorescent screen is very thin and transparent to visible or ultraviolet light so that a high numerical-aperture optical microscope objective can closely approach and view the screen.

31. A microflouroscope according to claim 25 and wherein:

the plasma source is in a vacuum; and an x-ray transparent vacuum window is used to separate the specimen, fluorescent screen, and microscope from the vacuum of the plasma source.

32. A microflouroscope according to claim 25 and wherein:

filters are used to limit the wavelengths of soft x-rays which reach the fluorescent screen to the desired energy range.

33. A microflouroscope according to claim 32 and wherein:

the filters are monochromator devices.

34. A microflouroscope according to claim 25 and wherein:

the plasma source of soft x-rays is an x-ray laser.

35. A microflouroscope according to claim 25 and wherein:

the soft x-rays are in the water-window wavelength range.

36. A microflouroscope according to claim 25 and wherein:

the specimen is living.

37. A microflouroscope according to claim 25 and wherein:

the fluorescent screen emits ultraviolet fluorescence and the microscope has an objective lens which is compatible with UV light.

38. A microflouroscope according to claim 25 and wherein:

x-ray optics are used to collimate the plasma radiation.

39. A microflouroscope according to claim 25 and wherein:

the relay optics are a hollow capillary tube.

40. A microflouroscope according to claim 25 and wherein:

the optical microscope has visible light condenser optics for performing standard light microscopy.

41. A microflouroscope according to claim 40 and wherein:

the plasma radiation is unobstructed by utilizing removable light condenser-optics.

42. A microflouroscope according to claim 25 and wherein:

multilayer mirrors are used in conjunction with the x-ray relay optic for redirecting the plasma radiation.

43. The combination for examining a specimen at a plane comprising:

a conventional microscope;

a plasma source of soft x-rays for producing diverging plasma radiation;

an x-ray relay optic aligned to collect at least part of the diverging plasma radiation and redirect part of the diverging plasma radiation to the plane of the conventional microscope;

a fluorescent screen placed at the plane of the conventional microscope to receive the redirected part of the diverging plasma radiation;

means for placing a specimen in close proximity to the plane of the conventional microscope so that an x-ray absorption shadow of the specimen is projected onto the fluorescent screen.

44. A microflouroscope according to claim 43 and wherein:

the optical microscope has confocal optics.

45. A microflouroscope according to claim 43 and wherein:

the optical microscope has fluorescence capabilities.

46. A microflouroscope according to claim 43 and wherein:

the optical microscope has phase contrast capabilities.

47. A microflouroscope according to claim 43 and wherein:

the optical microscope has interference capabilities.

* * * * *